US006354225B1

(12) United States Patent
Fichtner et al.

(10) Patent No.: US 6,354,225 B1
(45) Date of Patent: Mar. 12, 2002

(54) LINE-CHANGING DEVICE FOR TRACKS OF A MAGNETIC LEVITATION TRAIN

(75) Inventors: Karl Wilhelm Fichtner, München; Franz-Xaver Pichlmeier, Taufkirchen, both of (DE)

(73) Assignee: ThyssenKrupp Technologies AG, Essen (DE)

( * ) Notice: Subject to any disclaimer, the term of this patent is extended or adjusted under 35 U.S.C. 154(b) by 0 days.

(21) Appl. No.: 09/600,221

(22) PCT Filed: Dec. 22, 1998

(86) PCT No.: PCT/EP98/08397

§ 371 Date: Jul. 11, 2000

§ 102(e) Date: Jul. 11, 2000

(87) PCT Pub. No.: WO99/36627

PCT Pub. Date: Jul. 22, 1999

(30) Foreign Application Priority Data

Jan. 14, 1998 (DE) ..... 198 00 909

(51) Int. Cl.[7] ..... E01B 25/12

(52) U.S. Cl. ..... 104/130.03; 104/130.01; 104/130.02; 104/130.05

(58) Field of Search ..... 104/130.01, 130.02, 104/130.03, 130.05, 118, 281, 282

(56) References Cited

U.S. PATENT DOCUMENTS 1,286,042 A * 11/1918 McClure et al. ..... 104/130.01
2,977,893 A * 4/1961 Rosenbaum ..... 104/130.01
3,106,898 A * 10/1963 Prosin ..... 104/130.01
3,635,166 A * 1/1972 Peterson ..... 104/130.01
3,661,091 A * 5/1972 Noble ..... 104/130.01
3,964,398 A * 6/1976 Breitling ..... 104/130.01
5,511,488 A * 4/1996 Powell et al. ..... 104/281

FOREIGN PATENT DOCUMENTS

WO WO 98/05820 * 2/1998

* cited by examiner

*Primary Examiner*—S. Joseph Morano
*Assistant Examiner*—Lars A. Olson
(74) *Attorney, Agent, or Firm*—Max Fogiel

(57) ABSTRACT

A track-alternating arrangement for magnetic-levitation roadways, in which one of a series of mutually aligned bearers in each roadway establishes a first junction to join the roadways together. The bearer is inflectable to form the first junction. Each bearer, in an inflected state in one roadway, is aligned with another bearer in an adjacent roadway. An abutting one of the bearers adjacent the inflectable bearer is shiftable out beyond a free base of a car traveling over the roadway to provide sufficient space for the car to pass the junction. The abutting bearers are inflected to establish a different second junction. The inflectable bearers are shiftable out beyond a free cross-section of the car when the abutting bearers establish the different second junction.

12 Claims, 1 Drawing Sheet

LINE-CHANGING DEVICE FOR TRACKS OF A MAGNETIC LEVITATION TRAIN

BACKGROUND OF THE INVENTION

The present invention concerns track-alternating equipment for magnetic-levitation roadways.

One known approach to allowing a change from one magnetic levitation roadway to another adjacent involves special bearers clamped into position at one end at a point of contiguity between two roadways. Each bearer can be inflected toward the other roadway and the bearer accommodated therein. The free ends of the bearers are in alignment, and their midsections follow a prescribed inflection. Several horizontally acting bearer inflecting mechanisms and inflection-maintaining fasteners are accordingly distributed along each bearer between the midsection and the end and can be operated individually or together.

Establishing the bearers' inflection, their "curvature", by means of tabs that act against stops is also known.

German 4 416 819 A1 describes a junction with a bearer that can be inflected resiliently from one roadway toward the other. The inflected ends are in alignment and constitute the junction. The bearer adjoining the resilient end of the other bearer can be resiliently inflected out and away from the adjacent roadway.

This procedure establishes a transition between the roadways even when they are less than twice the open base of the car. This advantage, however, is attained at high engineering expenditure and without decreasing the distance between the roadways all that much.

SUMMARY OF THE NVENTION

The object of the present invention is track-alternating equipment of the aforesaid genus that can be employed to change from one magnetic-levitation roadway to another narrowly adjacent by means of relatively simple engineering.

This object is attained in accordance with the present invention by inflectable butting bearers that establish a different junction and in that the inflectable bearers can be shifted out beyond the open base of the car while the second junction is being established by the butting bearers.

One advantage of the present invention is that cars moving in the same direction can be diverted to the adjacent roadway no matter what roadway they are traveling over.

When two two-track contiguity points in accordance with the present invention are employed in series, a car can be diverted back and forth between one track and the other in a development section comprising four inflectable bearers. The equipment described in German 4 416 819 A1 on the other hand requires three junctions and six inflectable bearers for the same procedure.

When, in one practical embodiment of the present invention, the junction is constituted by the inflectable bearers, the inflectable bearers can be shifted out beyond the open base of the car without being subjected to deformation stress, and, when the junction is constituted by the butting bearers, the butting bearers can be shifted out beyond the open base of the car without being subjected to deformation stress.

Another advantage is that either the inflectable bearers or the butting bearers can be shifted out beyond the open base of the car without being subjected to inflection stress. Since this feature prevents mutual inflection stress, the bearers, material fatigue can be kept relatively low.

Another practical feature is that either the butting bearers or the inflectable bearers can be pivoted or rotated out beyond the open base of the car and specifically around a vertical axis.

The butting bearers and the inflectable bearers in another embodiment of the present invention can be accommodated in bearings with a vertical axis of rotation that can lock up to establish a junction.

One or more horizontally acting tabs can pivot the butting bearers and inflectable bearers out beyond the open base of the car. These tabs can preferably also participate in inflecting the bearers to establish a junction.

BRIEF DESCRIPTION OF THE DRAWINGS

The present invention will now be specified with reference to the accompanying drawing, wherein.

DESCRIPTION OF THE PREFERRED EMBODIMENTS

Figure 1:
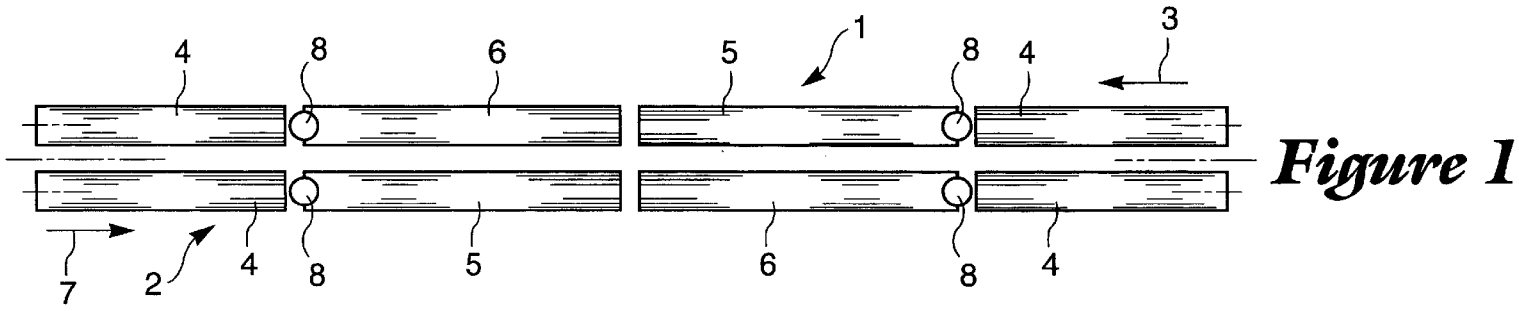
FIG. 1 is an overhead view of a two-track magnetic-levitation roadway and FIG. 2 a view similar to that in FIG. 1 of a junction established between the two tracks in states I and II.

A magnetically levitated car can travel over either of the two roadways 1 and 2 illustrated in FIG. 1. An unillustrated car traveling over roadway 1 in direction 3 will pass over a rigid bearer 4, an inflectable bearer 5, a butting bearer 6, and another rigid bearer 4.

An unillustrated car traveling over roadway 2 in opposing direction 7 on the other hand will pass in the same sequence over a rigid bearer 4, an inflectable bearer 5, a butting bearer 6, and another rigid bearer 4 in that roadway. A car can of course travel over either roadway 1 or roadway 2 in either direction 3 or 7.

Each inflectable bearer 5 and each butting bearer 6 can pivot on a rotating bearing 8 at the end adjacent to its adjacent rigid bearer 4 establishing a junction between the two roadways. The bearing then locks up.

Figure 2:
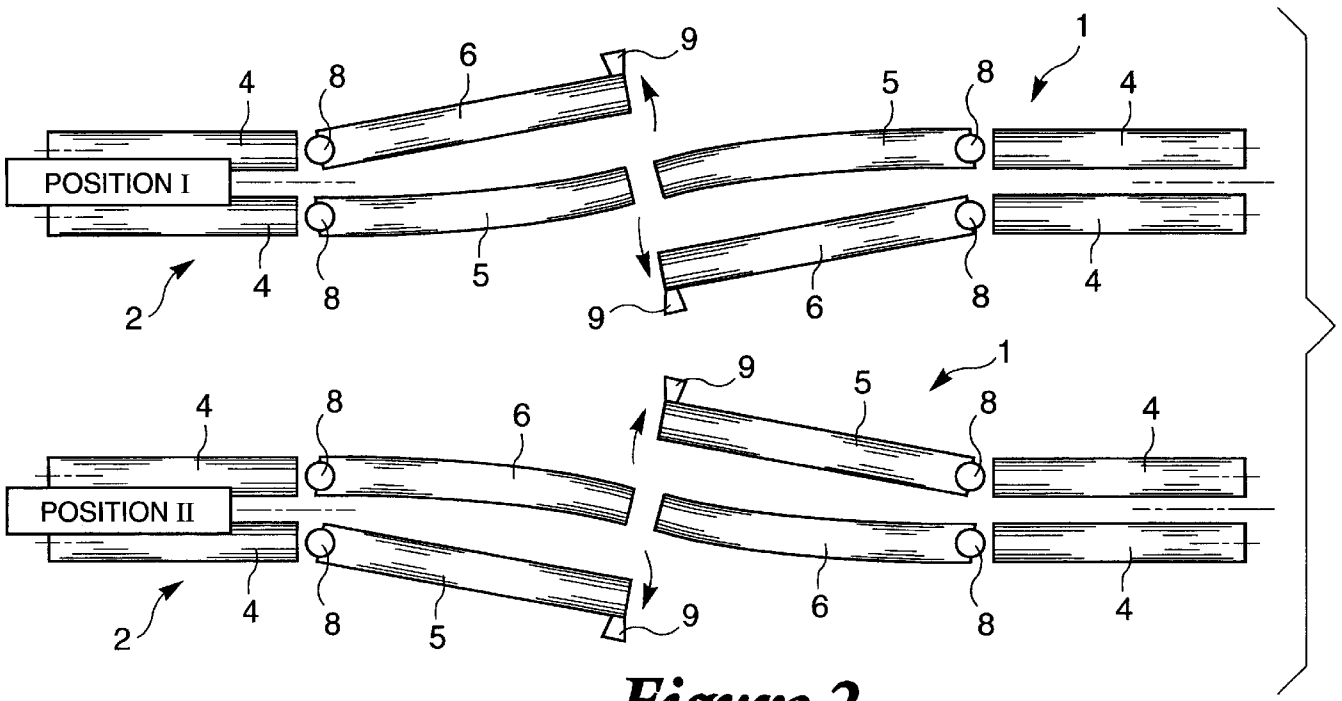

How such a junction is established will now be specified with reference to FIG. 2. In state I, inflectable bearers 5 are clamped into position by locked-up bearings 8 at one end. Bearers 5, however, are also being inflected from outside by unillustrated but in-themselves known horizontally acting motorized mechanisms accommodated in the space between the roadways. The bearers' inflection is maintained by these mechanisms themselves or by inflection-maintaining fasteners.

To ensure sufficient space at the side for the car as it travels over the junction with its open base embracing the roadway, each butting bearer 6 can be pivoted out on a rotating bearing 8 by one or more tabs 9 without being deformed. This feature represents a simple approach to providing enough room for the car to pass while avoiding the stress that would occur on butting bearers 6 if they were simultaneously being deformed.

The butting bearers 6 in the state II illustrated in FIG. 2 have been inflected to establish a junction between roadways 1 and 2. The rotating bearings 8 at the ends of butting bearers 6 are locked. Inflectable bearers 5 have been pivoted out on bearings 8 by tabs 9 beyond the car's open base.

Since butting bearers 6 can also be exploited to help establish a junction and since inflectable bearers 5 can also be shifted out beyond the open base of the car, the track-alternating equipment in accordance with the present invention can also be employed to establish a roadway-crossing point, as will be evident from consideration of states I and II.

What is claimed is:

1. A track-alternating arrangement for magnetic-levitation roadways, comprising: a series of mutually aligned bearers in said roadways, said bearers having a longitudinal axis and being nonrotatable about said axis; one of said bearers in each roadway for establishing a first junction to join the roadways together, said bearer being a bendable inflectable bearer to form said first junction, said bendable inflectable bearer being shiftable out beyond said free base of said car free of deformation stress to produce low fatigue in said inflectable bearer; each bearer in a bent inflected state in one roadway being aligned with another bearer in an adjacent roadway; an abutting one of said bearers adjacent said bendable inflectable bearer being shiftable out beyond a free base of a car traveling over said one roadway to provide sufficient space for the car to pass the first junction, said abutting one of said bearers being shiftable out beyond said free base of said car free of deformation stress to produce low fatigue in said abutting one of said bearers; means for inflecting abutting ones of said bearers to establish a different second junction, inflectable ones of said bearers being shiftable out beyond a free cross-section of the car when said abutting ones of said bearers establish said different second junction.

2. A track-alternating arrangement as defined in claim 1, wherein said inflectable ones of said bearers are shiftable out beyond the free base of the car free of deformation stress when said first junction is formed by said inflectable ones of said bearers, said abutting ones of said bearers being shiftable out beyond the free base of the car free of deformation stress when said second junction is established by said abutting ones of said bearers.

3. A track-alternating arrangement as defined in claim 2, wherein said inflectable ones of said bearers are shiftable out beyond said free base of the car free of inflection stress.

4. A track-alternating arrangement as defined in claim 2, wherein said abutting ones of said bearers are shiftable out beyond said free base of the car free of inflection stress.

5. A track-alternating arrangement as defined in claim 2, wherein said abutting ones of said bearers are rotatable out beyond said free base of the car.

6. A track-alternating arrangement as defined in claim 5, wherein said abutting ones of said bearers are rotatable out around a vertical axis.

7. A track-alternating arrangement as defined in claim 6, including bearings with a vertical axis of rotation for holding said abutting ones of said bearers and said inflectable ones of said bearers and locking up to establish a junction.

8. A track-alternating arrangement as defined in claim 7, including at least one horizontally acting tab on said abutting ones of said bearers and on said inflectable ones of said bearers for rotating said abutting ones of said bearers and said inflectable ones of said bearers out beyond said free base of the car.

9. A track-alternating arrangement as defined in claim 8, wherein said at least one tab participates also in inflecting said bearers to establish a junction.

10. A track-alternating arrangement as defined in claim 2, wherein said inflectable ones of said bearers are rotatable out beyond said free base of the car.

11. A track-alternating arrangement as defined in claim 10, wherein said inflectable ones of said bearers are rotatable out around a vertical axis.

12. A track-alternating arrangement for magnetic-levitation roadways, comprising: a series of mutually aligned bearers in said roadways, said bearers having a longitudinal axis and being nonrotatable about said axis; one of said bearers in each roadway for establishing a first junction to join the roadways together, said bearer being a bendable inflectable bearer to form said first junction, said bendable inflectable bearer being shiftable out beyond said free base of said car free of deformation stress to produce low fatigue in said inflectable bearer; each bearer in a bent inflected state in one roadway being aligned with another bearer in an adjacent roadway; an abutting one of said bearers adjacent said bendable inflectable bearer being shiftable out beyond a free base of a car traveling over said one roadway to provide sufficient space for the car to pass the first junction, said abutting one of said bearers being shiftable out beyond said free base of said car free of deformation stress to produce low fatigue in said abutting one of said bearers; means for inflecting abutting ones of said bearers to establish a different second junction, inflectable ones of said bearers being shiftable out beyond a free cross-section of the car when said abutting ones of said bearers establish said different second junction; said inflectable ones of said bearers being shiftable out beyond the free base of the car free of deformation stress when said first junction is formed by said inflectable ones of said bearers, said abutting ones of said bearers being shiftable out beyond the free base of the car free of deformation stress when said second junction is established by said abutting ones of said bearers; said inflectable ones of said bearers being shiftable out beyond said free base of the car free of inflection stress; said abutting ones of said bearers being shiftable out beyond said free base of the car free of inflection stress; said abutting ones of said bearers being rotatable out beyond said free base of the car; said inflectable ones of said bearers being rotatable out beyond said free base of the car; said abutting ones of said bearers being rotatable out around a vertical axis; said inflectable ones of said bearers being rotatable out around a vertical axis; bearings with a vertical axis of rotation for holding said abutting ones of said bearers and said inflectable ones of said bearers and locking up to establish a junction; at least one horizontally acting tab on said abutting ones of said bearers and on said inflectable ones of said bearers for rotating said abutting ones of said bearers and said inflectable ones of said bearers out beyond said free base of the car; said at least one tab participating also in inflecting said bearers to establish a junction.

* * * * *